US010149060B2

(12) United States Patent
Nie et al.

(10) Patent No.: US 10,149,060 B2
(45) Date of Patent: Dec. 4, 2018

(54) LONG STROKE SPEAKER

(71) Applicants: Yunhu Nie, Shenzhen (CN); Hongxing Wang, Shenzhen (CN); Shun Guo, Shenzhen (CN)

(72) Inventors: Yunhu Nie, Shenzhen (CN); Hongxing Wang, Shenzhen (CN); Shun Guo, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 8 days.

(21) Appl. No.: 15/341,555

(22) Filed: Nov. 2, 2016

(65) Prior Publication Data

US 2017/0150272 A1 May 25, 2017

(30) Foreign Application Priority Data

Nov. 20, 2015 (CN) ..... 2015 1 0815573
Jun. 15, 2016 (JP) ..... 2016-118610

(51) Int. Cl.
*H04R 9/06* (2006.01)
*H04R 7/18* (2006.01)
*H04R 9/02* (2006.01)

(52) U.S. Cl.
CPC ..... *H04R 9/06* (2013.01); *H04R 7/18* (2013.01); *H04R 9/025* (2013.01); *H04R 2400/03* (2013.01); *H04R 2499/11* (2013.01)

(58) Field of Classification Search
CPC ..... H04R 9/025
See application file for complete search history.

(56) References Cited

U.S. PATENT DOCUMENTS

| | | | | |
|---|---|---|---|---|
| 4,783,824 | A * | 11/1988 | Kobayashi | H04R 9/025 381/402 |
| 2009/0028371 | A1* | 1/2009 | Bailey | H04R 9/025 381/386 |
| 2010/0303278 | A1* | 12/2010 | Sahyoun | H04R 9/043 381/398 |
| 2011/0311091 | A1* | 12/2011 | Nagumo | H04R 11/02 381/398 |
| 2012/0170792 | A1* | 7/2012 | Li | H02K 33/16 381/412 |

* cited by examiner

*Primary Examiner* — Duc Nguyen
*Assistant Examiner* — Phan Le
(74) *Attorney, Agent, or Firm* — Na Xu; IPro, PLLC

(57) ABSTRACT

A long stroke speaker is provided in the present disclosure. The long stroke speaker includes a shell, a magnetic system, and a vibrating system. The magnetic system includes a magnet assembly and a magnetic guiding module cooperatively for forming a magnetic gap. The vibrating system includes a membrane, a coil support connected to the membrane, and a voice coil connected to the coil support. The magnet assembly includes a first magnet, a second magnet and a pole member, a magnetic direction of the first magnet and a magnetic direction of the second magnet are parallel to a vibration direction of the vibrating system, and an end of the first magnet adjacent to the pole member has a same polarity as an end of the second magnet adjacent to the pole member. The voice coil is arranged at the magnetic gap and surrounds the pole member.

13 Claims, 5 Drawing Sheets

LONG STROKE SPEAKER

FIELD OF THE DISCLOSURE

The present disclosure relates to electro-acoustic converting technologies, and more particularly, to a long stroke speaker applicable to a mobile communication device for producing audible sound.

BACKGROUND

Speakers are widely applied in mobile communication devices, such as mobile phones, tablet computers, laptop computers, portable game player, portable multimedia devices, or the like, for converting electrical signals into audible sounds. The speakers can be categorized into long stroke speakers and short stroke speakers according to stroke lengths of voice coils in the speakers.

A related long stroke speaker includes a vibration system, a magnetic system, and a holder for holding the vibration system and the magnetic system. The vibrating system includes a membrane, a coil support connected to the membrane, and a voice coil arranged on the coil support. As illustrated in FIG. 6, the vibrating system includes a pair of magnet modules opposite to each other, and the voice coil is disposed between the pair of magnet modules. To obtain good performance, the long stroke speaker needs to have a good power converting efficiency. However, it can be found from FIG. 6 that magnetic lines passing through the voice coil do not have a sufficient density, in other words, the magnetic utilization efficiency of the vibrating system is low. As such, each of the magnet modules needs to be large and takes up a large space in the long stroke speaker, to ensure the performance of the long stroke speaker. Nevertheless, this is adverse to miniaturization of the long stroke speaker, and also increases a cost of the long stroke speaker.

Therefore, it is desired to provide a new long stroke speaker which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiment thereof.

Figure 1:
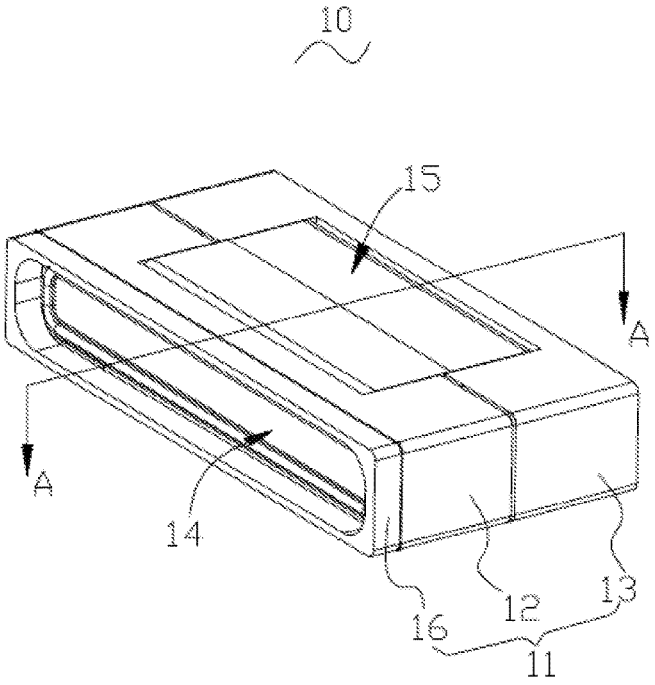
FIG. 1 is a schematic view of a long stroke speaker according to an embodiment of the present disclosure.
Figure 2:
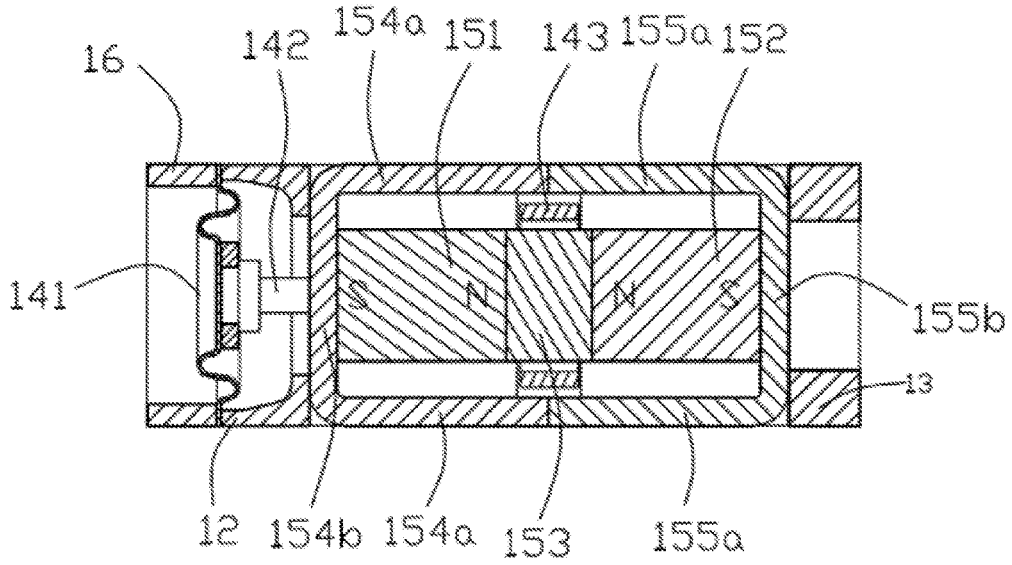
FIG. 2 is a cross-sectional view of the long stroke speaker of FIG. 1, taken along line A-A.
Figure 3:
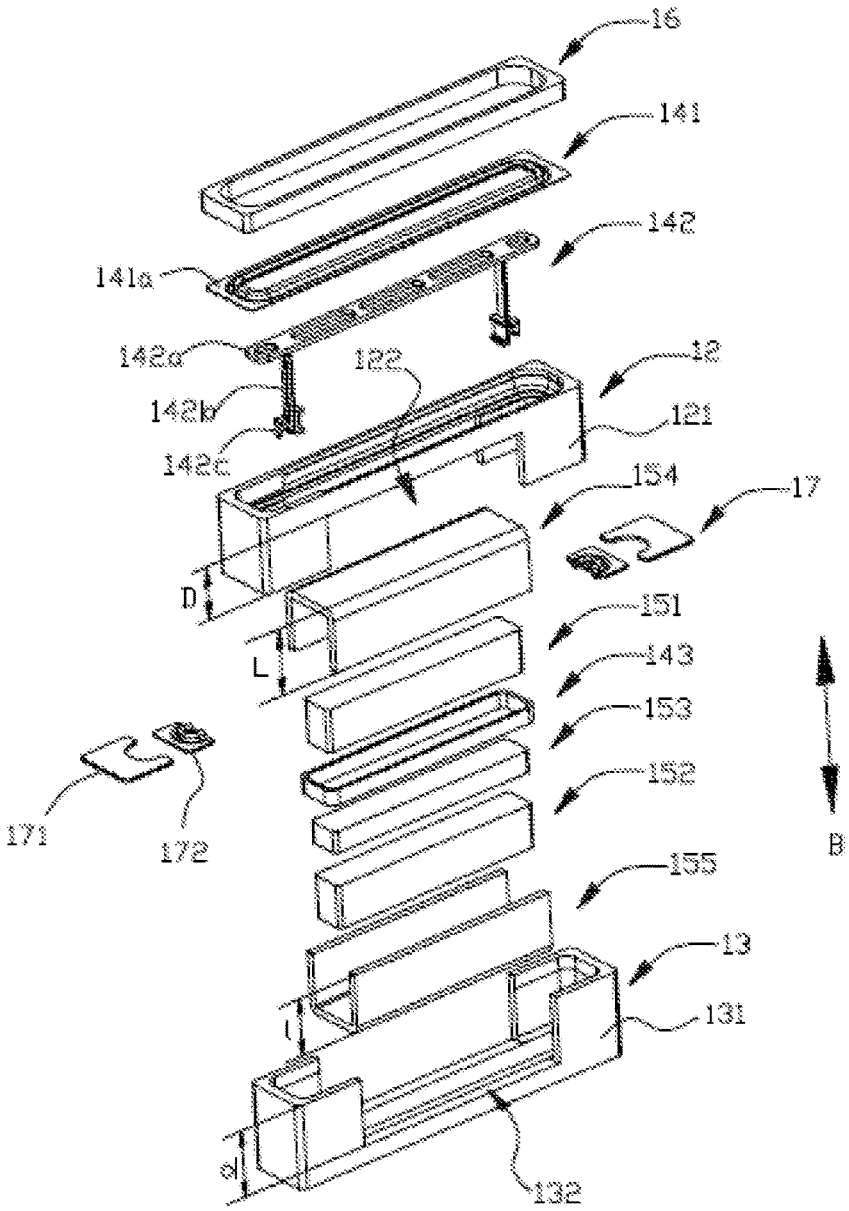
FIG. 3 is an exploded view of the long stroke speaker of FIG. 1.

Referring to FIGS. 1-3, a long stroke speaker 1 according to an embodiment of the present disclosure is shown. The long stroke speaker 1 includes a shell 11, a vibrating system 13 and a magnetic system 15. The shell 11 provides an accommodating space; the vibrating system 13 and the magnetic system 15 are accommodated in the accommodating space.

The shell 11 includes a front cover 16, a first shell body 12 and a second shell body 13. The front cover 16 is engaged to a front end of the first shell body 12, and may include a sound outlet formed opposite to the first shell body 12. The second shell body 13 is engaged to a rear end of the first shell body 12. In the present embodiment, the first shell body 12 and the second shell body 13 may be separate from each other; in an alternative embodiment, the first shell body 12 and the second shell body 13 may be integrated into a one-piece structure.

The vibrating system 14 includes a membrane 141, a coil support 142 connected to the membrane 141, and a voice coil 143 connected to the coil support 142. The membrane 141 includes a dome arranged at a main central region thereof, and a suspension surrounding the dome; in addition, in the present embodiment, the suspension of the membrane 141 includes a periphery part 141*a*, the periphery part 141 may be sandwiched between the front cover 16 and the front end of the first shell body 12 which faces the front cover 16.

The coil support 142 includes a supporting part 142*a* and a pair of connecting arms 142*b*. The membrane 141 may be arranged on and supported by the supporting part 142*a* of the coil support 142; for example, the supporting part 142*a* may be connected to a bottom surface of the membrane 141, which faces the magnetic system 15. The pair of connecting arms 142 extends from a bottom of the supporting part 142*a* along a vibration direction of the membrane 141 (i.e., a direction B in FIG. 1), and is parallel to each other. Each of the connecting arms 142*b* may be connected to a respective short side of the voice coil 143. Moreover, each of the connecting arms 142*b* includes an extending part 142*c* at an end thereof connected to the voice coil 143, and the extending part 142*c* extends substantially along a direction opposite to a central of the voice coil 143.

Furthermore, to enhance a stability of the vibrating system 14, the long stroke speaker 10 further includes an auxiliary system 17; the auxiliary system 17 includes a pair of auxiliary parts symmetrical to each other. Each of the auxiliary parts includes a fixed piece 171 and a flexible member 172. The fixed piece 171 is fixed to the shell 11, for example, the fixed piece 171 may be arranged between the first shell body 12 and the second shell body 13. The flexible member 172 includes a first end connected to the fixed piece 171, and an opposite second end connected to an extending part 142*c* of a corresponding one of the connecting arms 142*b*.

Figure 4:
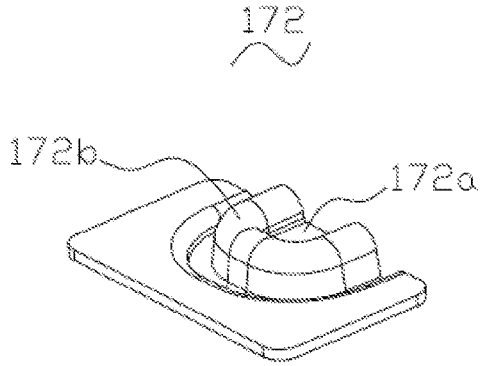
FIG. 4 is a schematic view of a flexible member of an auxiliary system of the long stroke speaker of FIG. 3.

As illustrated in FIG. 4, the flexible member 172 includes a central part 172*a* connected to the corresponding extending part 142*c* of the connecting arm 142*b*, and a periphery part 172*b* surrounding the central part 172*a*. The periphery part 172*b* may have a configuration substantially similar to the suspension of the membrane 141. When the coil support 142 brings the voice coil 142 arranged thereon to vibrate, the connecting piece 171 does not perform movement or vibration due to its connection with to the shell 11; in contrast, the flexible member 172 is forced to vibrate by the coil support 142 in a vibrating manner coincident with that of the membrane 141.

The magnetic system 15 includes a magnet assembly and a magnetic guiding module surrounding the magnet assembly. The magnet assembly includes a first magnet 151, a second magnet 152 and a pole member 153 arranged between the first magnet 151 and the second magnet 152. Magnetic directions of the first magnet 151 and the second magnet 152 are both parallel to the vibrating direction of the vibrating system 14. In addition, a polarity of an end of the first magnet 151 adjacent to the pole member 153 is same as that of an end of the second magnet 152 adjacent to the pole member 153, for example, each of which may be an N-pole end; and the other ends of the first magnet 151 and the second magnet 152 distant from the pole member 153 may both be S-pole ends, as illustrated in FIG. 2. Alternatively, in other embodiment, the ends of the first magnet 151 and the second magnet 152 adjacent to the pole member 153 may be S-pole ends, while the ends distant from the pole member 153 may be N-pole ends.

In a preferred embodiment of the present disclosure, the first shell body 12 and the second shell body 13 are separate from each other, so as to facility an assembly of the magnetic system 15. The first shell body 12 includes two first sidewalls 121 opposite to each other along the vibrating direction of the vibrating system 14, and a first opening 122 penetrating through the two first sidewalls 121. The second shell body 13 includes two second sidewalls 131 opposite to each other along the vibrating direction of the vibrating system 14, and a second opening 132 penetrating through the two second sidewalls 131. The first opening 122 and the second opening 132 are both semi-close openings, which are opposite to each other and can cooperatively form a receiving space for receiving the magnetic guiding module.

In the present embodiment, the magnetic guiding module includes a first magnetic guiding member 154 arranged at the first shell body 12, and a second magnetic guiding member 155 arranged at the second shell body 13. For example, the first magnetic guiding member 154 includes two parallel first magnetic guiding walls 154*a* arranged in the first opening 122, and a first connecting wall 154*b* connected to the two first magnetic guiding walls 154*a* at edges of the two first magnetic guiding walls 154*a* distant from the second shell body 13. The second magnetic guiding member 155 includes two parallel second magnetic guiding walls 155*a* arranged in the second opening 132, and a second connecting wall 155*b* connected to the two second magnetic guiding walls 155*a* at edges of the two second magnetic guiding walls 155*a* distant from the first shell body 12. With this configuration, the first magnetic guiding member 154 and the second magnetic guiding member 155 may be assembled to form a ring-shaped magnetic guiding module for receiving the magnet assembly.

The magnet assembly is arranged in the magnetic guiding module, so that an end of the first magnet 151 and an end of the second magnet 152 abut on the first connecting wall 154*b* and the second connecting wall 155*b* respectively. Moreover, magnetic gaps are formed between the first magnetic guiding walls 154*a* and the magnet assembly, as well as between the second magnetic guiding walls 155*a* and the magnet assembly. The voice coil 143 can be arranged in the magnetic gaps and surround the pole member 153. In operation, the voice coil 143 may perform reciprocating motion in the magnetic gaps due to a magnetic force applied thereto, and thus driving the membrane 141 to vibrate and produce sound.

In other words, in the present embodiment, the magnetic guiding module can not only provide a magnetic guiding function for accumulating magnetic lines, but also function as fixing the magnet assembly. In other embodiments, the magnetic guiding module may be a one-piece assembly other than a separable assembly. For example, in an alternative embodiment, the magnetic guiding module includes a first magnetic guiding plate and a second magnetic guiding plate; the shell includes a first sidewall and a second sidewall opposite to each other, each of which includes a receiving hole for receiving a corresponding one of the first magnetic guiding plate and the second magnetic guiding plate; the magnet assembly is located in the shell between the first magnetic guiding plate and the second magnetic guiding plate. In addition, the magnet assembly may be fixed in the shell in other manner, as long as the voice coil is capable of performing reciprocating motion.

Furthermore, a length L of the first magnetic guiding wall 154*a* along the vibrating direction is greater than a depth D of the first opening 122 in the same direction, and a length l of the second magnet guiding wall 155*a* along the vibrating direction is less than a depth d of the seconding opening 132 in the same direction. In other words, the first magnetic guiding wall 154*a* extends into the second opening 132, which makes the magnetic guiding module is fixed more tightly.

Figure 5:
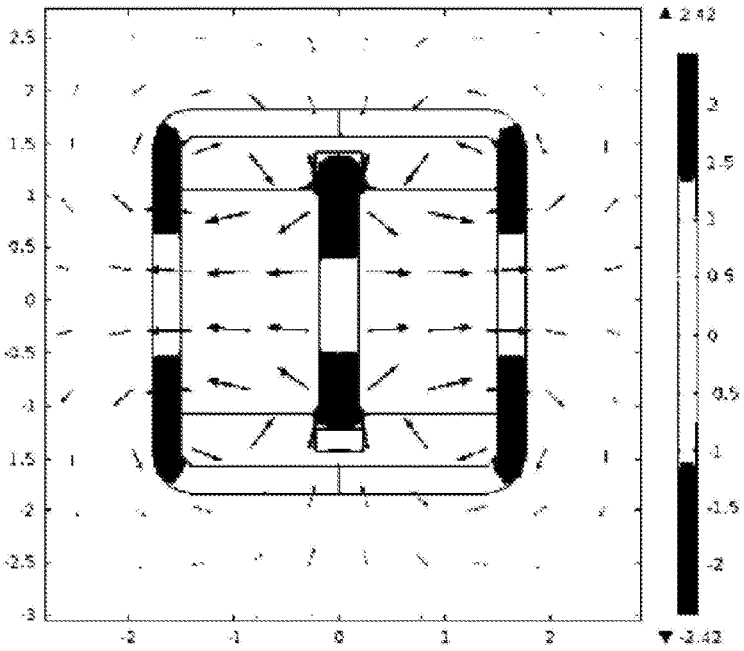
FIG. 5 illustrates a distribution of magnetic lines in the long stroke speaker of FIG. 1.
Figure 6:
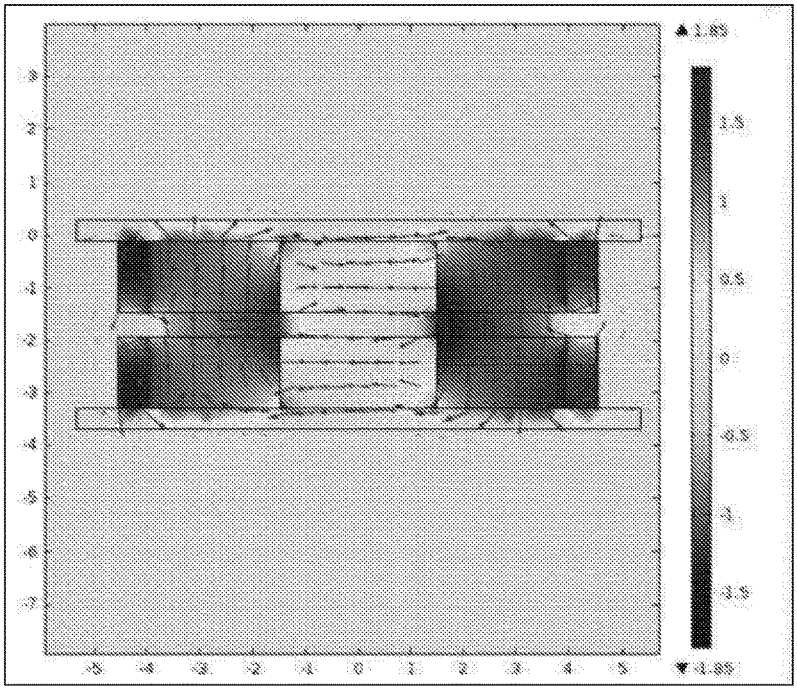
FIG. 6 (related art)
FIG. 6 illustrates a distribution of magnetic lines in a related long stroke speaker.

Referring to FIG. 5, a distribution of magnetic lines in the long stroke speaker 10 is shown. It can be found from FIG. 5 that the magnetic system 15 in the long stroke speaker 10 is more concentrative, and a density of the magnetic lines passing through the voice coil 13 is sufficient to enable the long stroke speaker 10 to obtain a high power converting efficiency. Accordingly, the magnet assembly 15 can occupy a smaller space while maintain a good performance of the long stroke speaker 10.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A long stroke speaker, comprising:

a shell comprising a first shell body and a second shell body connected to the first shell body; the first shell body comprises two first sidewalls opposite to each other along the vibrating direction, and a first opening penetrating through the two first sidewalls; the second shell body comprises two second sidewalls opposite to each other along the vibrating direction, and a second opening penetrating through the two second sidewalls;

a magnetic system received in the shell and comprising a magnet assembly and a magnetic guiding module cooperatively forming a magnetic gap; and a vibrating system comprising a membrane, a coil support connected to the membrane, and a voice coil connected to the coil support;

wherein the magnet assembly comprises a first magnet, a second magnet and a pole member between the first magnet and the second magnet, a magnetic direction of the first magnet and a magnetic direction of the second magnet are parallel to a vibration direction of the vibrating system, and an end of the first magnet adjacent to the pole member has a same polarity as an end of the second magnet adjacent to the pole member; the voice coil is arranged at the magnetic gap and surrounds the pole member, and is configured for performing reciprocating motion to drive the membrane to vibrate and produce sound; and the magnetic guiding module comprises a first magnetic guiding member and a second magnetic guiding member; the first magnetic guiding member comprises two parallel first magnetic guiding walls arranged in the first opening, and a first connecting wall connected to the two first magnetic guiding walls at edges of the two first magnetic guiding walls distant from the second shell body; the second magnetic guiding member comprises two parallel second magnetic guiding walls arranged in the second opening, and a second connecting wall connected to the two second magnetic guiding walls at edges of the two second magnetic guiding walls distant from the first shell body.

2. The long stroke speaker of claim 1, wherein the first opening and the second opening are both semi-close openings, and cooperatively form a receiving space for receiving the magnetic guiding module.

3. The long stroke speaker of claim 2, wherein the magnetic guiding module has a ring-shaped structure.

4. The long stroke speaker of claim 1, wherein the magnet assembly is arranged in the magnetic guiding module, so that an end of the first magnet and an end of the second magnet abut on the first connecting wall and the second connecting wall respectively.

5. The long stroke speaker of claim 1, wherein a length of the first magnetic guiding wall along the vibrating direction is greater than a depth of the first opening in the same direction, and a length of the second magnet guiding wall along the vibrating direction is less than a depth of the seconding opening in the same direction.

6. The long stroke speaker of claim 5, wherein the first magnetic guiding wall extends into the second opening.

7. The long stroke speaker of claim 1, wherein the shell further comprises a front cover connected to the first shell body; the membrane comprises a dome and a suspension surrounding the dome; a periphery part of the suspension is sandwiched between the front cover and the first shell body.

8. The long stroke speaker of claim 1, wherein the coil support comprises a supporting part and a pair of connecting arms; the membrane is arranged on the supporting part, and the pair of connecting arms extends from a bottom of the supporting part along the vibration direction of the membrane and is connected to the voice coil.

9. The long stroke speaker of claim 8, wherein each of the connecting arms comprises an extending part; the extending part extends substantially along a direction opposite to a central of the voice coil.

10. The long stroke speaker of claim 9, wherein the long stroke speaker further comprises an auxiliary system, the auxiliary system comprises a pair of auxiliary parts symmetrical to each other.

11. The long stroke speaker of claim 10, wherein each of the auxiliary parts comprises a fixed piece and a flexible member; the fixed piece is fixed to the shell, the flexible member comprises a first end connected to the fixed piece, and a second end connected to an extending part of a corresponding one of the connecting arms.

12. The long stroke speaker of claim 11, wherein the fixed piece is arranged between the first shell body and the second shell body.

13. The long stroke speaker of claim 11, wherein the flexible member comprises a central part connected to the corresponding extending part of the connecting arm, and a periphery part surrounding the central part.

* * * * *